United States Patent [19]

Froes et al.

[11] Patent Number: 5,067,988

[45] Date of Patent: Nov. 26, 1991

[54] LOW TEMPERATURE HYDROGENATION OF GAMMA TITANIUM ALUMINIDE

[75] Inventors: Francis H. Froes, Moscow, Id.; D. Simon Shong, Kaohsiung, Taiwan; Young-Won Kim, Dayton, Ohio; Frederick C. Yolton, Coraopolis, Pa.

[73] Assignee: The United States of America as represented by the Secretary of the Air Force, Washington, D.C.

[21] Appl. No.: 474,197

[22] Filed: Feb. 2, 1990

[51] Int. Cl.[5] ..... C22F 1/18

[52] U.S. Cl. ..... 148/20.3; 148/133; 148/11.5 F; 428/614

[58] Field of Search ..... 148/20.3, 133

[56] References Cited

U.S. PATENT DOCUMENTS

| | | | |
|---|---|---|---|
| 4,415,375 | 11/1983 | Lederich et al. | 148/11.5 |
| 4,505,764 | 4/1985 | Smickley et al. | 148/133 |
| 4,612,066 | 9/1986 | Levin et al. | 148/20.3 |
| 4,680,063 | 7/1987 | Vogt et al. | 148/11.5 |
| 4,746,374 | 5/1988 | Froes et al. | 148/11.5 |
| 4,820,360 | 4/1989 | Eylon et al. | 148/133 |
| 4,822,432 | 4/1989 | Eylon et al. | 148/127 |

*Primary Examiner*—R. Dean
*Assistant Examiner*—Sikyin Ip
*Attorney, Agent, or Firm*—Charles E. Bricker; Donald J. Singer

[57] ABSTRACT

A method for refining the microstructure and enhancing the processability of titanium aluminum alloys containing about 45 to 55 atomic percent aluminum which comprises the steps of:

(a) rapidly solidifying a titanium aluminum alloy containing about 45 to 55 atomic percent aluminum to provide a rapidly solidified material having at least one dimension not greater than about 100 micrometers;

(b) diffusing hydrogen into the resulting rapidly solidified material at a temperature in the approximate range of 400° to 780° C., and;

(c) diffusing hydrogen out of the hydrogenated solid material.

12 Claims, No Drawings

LOW TEMPERATURE HYDROGENATION OF GAMMA TITANIUM ALUMINIDE

RIGHTS OF THE GOVERNMENT

The invention described herein may be manufactured and used by or for the Government of the United States for all governmental purposes without the payment of any royalty.

BACKGROUND OF THE INVENTION

This invention relates to gamma-titanium aluminide alloys.

Titanium alloys have found wide use in gas turbines in recent years because of their combination of high strength and low density, but generally, their use has been limited to below 600° C. due to inadequate strength and oxidation properties. At higher temperatures, relatively dense iron, nickel, and cobalt base super-alloys have been used. However, lightweight alloys are still most desirable, as they inherently reduce stresses when used in rotating components.

While major work has been performed since the 1950's on lightweight titanium alloys for higher temperature use, none has proved suitable for engineering application. To be useful at higher temperature, titanium alloys need the proper combination of properties. In this combination are properties such as high ductility, tensile strength, fracture toughness, elastic modulus, resistance to creep, fatigue and oxidation, and low density. Unless the material has the proper combination, it will not perform satisfactorily, and thereby be use-limited. Furthermore, the alloys must be metallurgically stable in use and be amenable to fabrication, as by casting and forging. Basically, useful high temperature titanium alloys must at least outperform those metals they are to replace in some respect, and equal them in all other respects. This criterion imposes many restraints and alloy improvements of the prior art once thought to be useful are, on closer examination, found not to be so. Typical nickel base alloys which might be replaced by a titanium alloy are INCO 718 or IN100.

Heretofore, a favored combination of elements with potential for higher temperature use has been titanium with aluminum, in particular alloys derived from the intermetallic compounds or ordered alloys $Ti_3Al$ (alpha-2) and TiAl (gamma). Laboratory work in the 1950's indicated these titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys.

The two titanium aluminides, $Ti_3Al$ and TiAl, could serve as a base for new high temperature alloys. Those skilled in the art recognize that there is a substantial difference between the two ordered titanium-aluminum intermetallic compounds. Alloying and transformational behavior of $Ti_3Al$ resemble those of titanium as they have very similar hexagonal crystal structures. However, the compound TiAl has a face-centered tetragonal arrangement of atoms and thus rather different alloying characteristics. Such a distinction is often not recognized in the earlier literature. Therefore, the discussion hereafter is largely restricted to that pertinent to the invention, which is within the TiAl gamma phase realm, i.e., about 50Ti-50Al atomically and about 65Ti-35Al by weight.

The effect of hydrogen on the physical and mechanical properties in alpha, beta and alpha-beta titanium alloys, i.e., titanium-aluminum alloys containing up to about 14 atomic percent (8 wt %) aluminum, has received considerable attention. It has been used to embrittle titanium to facilitate its comminution by mechanical means to form titanium metal powders. In such techniques hydrogen is diffused into the titanium at elevated temperatures, the metal is cooled and brittle titanium hydride is formed. The brittle material is then fractured to form a powder. The powder may then have the hydrogen removed or a compact may be formed of the hydrided material which is then dehydrided.

Hydrogen has the effect of increasing the high temperature ductility of titanium alloys. This characteristic has been used to facilitate the hot working of titanium alloys. Hydrogen is introduced to the alloy which is then subjected to high temperature forming techniques, such as forging or superplastic forming. The presence of hydrogen allows significantly more deformation of the metal without cracking or other detrimental effects, Lederich et al, U.S. Pat. No. 4,415,375.

Hydrogen has also been used as a temporary alloying element in an attempt to alter the microstructure and properties of titanium alloys. In such applications, hydrogen is diffused into the titanium alloys, the alloys heat treated by various means including cooling to room temperature and then heated to remove the hydrogen. Vogt et al, U.S. Pat. No. 4,680,063. Alternatively, hydrogen is diffused into the titanium alloys and then removed from the alloys. Smickley et al, U.S. Pat. No. 4,505,764.

In the as-processed condition, cast TiAl has a large average grain size, with grain size ranging from about 100 microns to 1000 microns, or greater. As discussed above, hydrogen has been employed very effectively to refine the microstructure of conventional Ti alloys, i.e., Ti alloys containing up to about 8 wt % Al. Unfortunately, the addition of hydrogen to gamma-titanium aluminide is not possible conventionally because of the very low solubility of hydrogen in the face-centered tetragonal matrix. What is desired is a method for adding hydrogen to the gamma-titanium aluminide which will allow enhanced processability and/or subsequent refinement of the microstructure of gamma-titanium aluminide in a manner similar to that possible in conventional titanium alloys and the intermetallic compound $Ti_3Al$.

Accordingly, it is an object of the present invention to provide a method for adding hydrogen to titanium aluminide (TiAl) to allow enhanced processability and microstructural refinement.

Other objects, aspects and advantages of the present invention will become apparent to those skilled in the art from a reading of the following detailed description of the invention.

SUMMARY OF THE INVENTION

In accordance with the present invention, there is provided a method for refining the microstructure and enhancing the processability of titanium aluminum alloys containing about 45 to 55 atomic percent aluminum which comprises the steps of:

(a) rapidly solidifying a titanium aluminum alloy containing about 45 to 55 atomic percent aluminum to provide a rapidly solidified material having at least one dimension not greater than about 100 micrometers;

(b) diffusing hydrogen into the resulting rapidly solidified material at a temperature in the approximate range of 400° to 780° C., and;

(c) diffusing hydrogen out of the hydrogenated solid material.

DETAILED DESCRIPTION OF THE INVENTION

The titanium-aluminum alloys suitable for use in the present invention are those alloys containing about 50 atomic percent Al (about 35 wt %), balance Ti. In addition, the Ti-Al alloy may contain varying amounts of other alloying elements, such as, for example, Nb, Cr, Mn, Mo, V, W, B, Si and C. Examples of suitable alloys include Ti-35Al, Ti-34Al-1.3V-0.52C, and the like.

Several techniques are known for producing rapidly-solidified material, including those known in the art as Chill Block Melt Spinning (CBMS), Planar Flow Casting (PFC), Melt Drag (MD), Crucible Melt Extraction (CME), Melt Overflow (MO), Pendant Drop Melt Extraction (PDME), Rotating Electode Process (REP) and Plasma Rotating Electode Process (PREP).

Typically, these techniques employ a cooling rate of about $10^4$ to $10^{10}$ deg-K/sec and produce a material about 10 to 100 micrometers thick.

A technique such a Drop Tube processing may also be used in which the material is significantly undercooled below its normal freezing point before soldification occurs. The subsequent solidification then occurs with an extremely fast solid-liquid interface velocity, thereby providing the same results as the rapid solidification processes. As used herein, and in the claims, the term "rapid solidification" includes Drop Tube processing.

Rapid solidification of the titanium aluminide alloy provides a metastable hexagonal, close-packed crystal structure (alpha-two structure) in the alloy, rather than the conventional or equilibrium face-centered tetragonal crystal structure (gamma structure). The alpha-two structure is metastable because, although the alpha-two crystal structure can be present in the TiAl alloy, the alpha-two crystal structure transforms or decomposes to the gamma structure upon heating and/or with passage of time.

The rapidly solidified material with its hexagonal, close-packed crystal structure is hydrogenated to a level of up to about 20,000 wppm (weight parts per million) hydrogen (2.0 wt %), preferably about 250 to 5000 wppm hydrogen. The addition of hydrogen is carried out using any suitable apparatus. Because hydrogen is highly flammable, it is presently preferred to carry out the hydrogenation using a mixture of hydrogen and an inert gas, such as argon or helium. A typical composition for a nonflammable gas environment would be a mixture consisting of 96 weight percent argon and 4 weight percent hydrogen. The composition of the gas is not critical, but it is preferred that the quantity of hydrogen be less than about 5 weight percent to avoid creation of a flammable mixture. It is, however, within the scope of this invention to employ a gas mixture containing more than about 5 weight percent hydrogen, as well as pure hydrogen.

The temperature at which the hydrogen is added to the alloy is at least about 400° C. and not greater than about 780° C. For the alloy TiAl, hydrogen addition is relatively slow up to about 480° C., at which point, there is a sharp increase in the rate of hydrogen absorption. For the alloy Ti-34Al-1.3V-0.52C, hydrogen addition is relatively slow up to about 430° C., at which point, there is a sharp increase in the rate of hydrogen absorption. A maximum temperature of about 780° C. is used to avoid transformation of the metastable hexagonal close-packed crystal structure to the equilibrium, face-centered tetragonal crystal structure, since formation of the stable structure would prevent diffusion of hydrogen into the alloy.

The rapidly solidified material can be consolidated in a suitable mold to form sheetstock, bar-stock or net shape articles such as turbine vanes. Consolidation is accomplished by the application of heat and pressure over a period of time. Consolidation is carried out at a temperature of about 0° to 250° C. (0° to 450° F.) below the beta transus temperature of the alloy. The pressure required for consolidation ranges from about 35 to about 300 MPa (about 5 to 45 Ksi) and the time for consolidation ranges from about 15 minutes to 24 hours or more. Consolidation under these conditions permits retention of the fine grain size of the rapidly solidified alloy.

It is within the scope of this invention to consolidate the hydrogenated alloy material into a desired article, then dehydrogenate the article, as well as to dehydrogenate the alloy material and then consolidate the material into a desired article. Dehydrogenation of the hydrogenated material or article is accomplished by heating the material or article under vacuum to a temperature in the range of about 400° to 780° C. The time for hydrogen removal will depend on the size and cross-section of the material or article, the volume of hydrogen to be removed, the temperature of dehydrogenation and the level of vacuum in the apparatus used for dehydrogenation. The term "vacuum" is intended to mean a vacuum of about $10^{-2}$ mm Hg or less, preferably about $10^{-4}$ mm HG or less. The time for dehydrogenation must be sufficient to reduce the hydrogen content in the material or article to less than the maximum allowable level, i.e., generally about 10 wppm or less. Generally, about ¼ to 4 hours at dehydrogenation temperature and under vacuum is sufficient to ensure substantially complete diffusion of hydrogen out of the material or article. Heating is then discontinued and the material or article is allowed to cool at a controlled rate, e.g., about 5° to 40° C. per minute, to room temperature.

It is also within the scope of the present invention to heat treat the hydrogenated material or article. One method of heat treatment comprises cooling the hydrogen-containing material or article to ambient temperature at a controlled rate, e.g., about 5° to 40° C. per minute, followed by heating the hydrogen-containing material or article to an elevated temperature and diffusing hydrogen out of the material or article, as discussed previously.

The following example illustrates the invention.

EXAMPLE

Alloy powders were produced by plasma rotating electode atomization techniques from Ti-35Al and Ti-34Al-1.3V-0.52C. Samples of each alloy were hydrogenated at 427° C., 482° C. and 538° C. for 20 hours in a vacuum chamber backfilled with 0.02 MPa (3 psi) pressure of hydrogen. The hydrogen concentrations for both alloy powders in the as-atomized and as-hydrogenated conditions are given in Table I, below:

TABLE I

| | Hydrogen Content (ppm by weight) in Alloy Powders | | | |
|---|---|---|---|---|
| | | Hydrogenated at | | |
| | As-Atomized | 427° C. | 482° C. | 538° C. |
| Ti—35Al | 5.3 | 10.5 | 26.9 | 300.9 |
| Ti—34Al—1.3V—0.52C | 13.43 | 36.32 | 281.0 | 541.45 |

As shown in Table I, the hydrogen content increased as the hydrogenation temperature increased for both alloy powders. Under all conditions, the Ti-34Al-1.3V-0.52C alloy absorbed more hydrogen than did the TiAl alloy. There was a sharp increase in hydrogen absorption at 538° C. for TiAl and at 482° C. for Ti-34Al-1.3V-0.52C.

X-ray diffraction (XRD) analyses of each of the powders, before and after hydrogenation, indicated that in the as-atomized condition, the powders contained only the metastable hexagonal, close-packed alpha-two phase. For Ti-35Al, after 482° C. hydrogenation, the alpha-two phase was still the only phase present. After 538° C. hydrogenation, the gamma phase became the predominant product, indicated by a strong gamma(111) peak. For Ti-34Al-1.3V-0.52C., hydrogenation resulted in progressive decomposition of the metastable alpha-two phase to the stable gamma phase with increasing temperatures. After 538° C. hydrogenation, the gamma phase became the predominant product, indicated by a strong gamma(111) peak.

For comparison, the as-atomized powders were aged under vacuum at 538° C. for 20 hours. The XRD patterns for both Ti-35Al and Ti-34Al-1.3V-0.52C powders indicated that alpha-two was still the predominant phase, indicated by strong alpha-two(201) peaks. Aging of both powders under vacuum for one week led to alpha-two to gamma decomposition, however not to the same extent as the alloy powders subjected to hydrogenation.

Differential Thermal Analysis (DTA) was employed to measure the decomposition temperature for the alpha-two to gamma transformation. All the DTA experiments were conducted under a high purity argon atmosphere. For TiAl, the alpha-two to gamma transformation temperatures were the same, 780° C., for three hydrogen levels, 5.3 wppm, 10.5 wppm and 26.9 wppm. For Ti-34Al-1.3V-0.52C, the alpha-two to gamma transformation temperatures were the same, 752° C., for powders with low hydrogen contents, 13.43 wppm and 36.32 wppm. However, for the powder having a higher hydrogen content, 281.0 wppm, the alpha-two to gamma transformation temperature was 732° C.

Microscopic examination of the transformed material revealed that average grain size was much smaller than 100 microns. In contrast, as indicated previously, the grain size of cast titanium aluminide ranges from about 100 microns up to 1000 microns, or greater.

Various modifications may be made to the invention as described without departing from the spirit of the invention or the scope of the appended claims.

We claim:

1. A method for refining the microstructure and enhancing the processability of gamma titanium-aluminum alloys which comprises the steps of:

(a) rapidly solidifying said alloy to provide a rapidly solidified material having at least one dimension not greater than about 100 micrometers;

(b) diffusing hydrogen into the resulting rapidly solidified material at a temperature in the approximate range of 400° to 780° C., and;

(c) diffusing hydrogen out of the hydrogenated solid material.

2. The method of claim 1 further comprising the step of heat treating the hydrogenated solid material prior to diffusing hydrogen out of said material.

3. The method of claim 1 wherein said alloy is Ti-35Al.

4. The method of claim 1 wherein said alloy is Ti-34Al-1.3V-0.52C.

5. A method for producing a molded article from gamma titanium-aluminum alloys which comprises the steps of:

(a) rapidly solidifying said alloy to provide a rapidly solidified material having at least one dimension not greater than about 100 micrometers;

(b) diffusing hydrogen into the resulting rapidly solidified material at a temperature in the approximate range of 400° to 780° C.;

(c) diffusing hydrogen out of the hydrogenated solid material, and;

(d) consolidating said solid material in a suitable mold at a temperature of about 0° to 250° C. below the beta transus temperature of said alloy at a pressure of about 5 to 45 ksi to produce said article.

6. The method of claim 5 further comprising the step of heat treating the hydrogenated solid material prior to diffusing hydrogen out of said material.

7. The method of claim 5 wherein said alloy is Ti-35Al.

8. The method of claim 5 wherein said alloy is Ti-34Al-1.3V-0.52C.

9. A method for producing a molded article from gamma titanium-aluminum alloys which comprises the steps of:

(a) rapidly solidifying said alloy to provide a rapidly solidified material having at least one dimension not greater than about 100 micrometers;

(b) diffusing hydrogen into the resulting rapidly solidified material at a temperature in the approximate range of 400° to 780° C.;

(c) consolidating said solid material in a suitable mold at a temperature of about 0° to 250° C. below the beta transus temperature of said alloy at a pressure of about 5 to 45 ksi to produce said article, and;

(d) diffusing hydrogen out of said article.

10. The method of claim 9 further comprising the step of heat treating the hydrogenated solid article prior to diffusing hydrogen out of said article.

11. The method of claim 9 wherein said alloy is Ti-35Al.

12. The method of claim 9 wherein said alloy is Ti-34Al-1.3V-0.52C.

* * * * *